United States Patent [19]

Newman

[11] Patent Number: 4,865,569

[45] Date of Patent: Sep. 12, 1989

[54] VARIABLE HEIGHT MARINE PROPULSION MECHANISM

[75] Inventor: Neil A. Newman, Omro, Wis.

[73] Assignee: Brunswick Corporation, Skokie, Ill.

[21] Appl. No.: 181,515

[22] Filed: Apr. 14, 1988

[51] Int. Cl.[4] ..... F16H 35/00

[52] U.S. Cl. ..... 440/53; 74/384; 440/75; 440/900

[58] Field of Search ..... 440/54, 75, 53, 900; 74/640, 380, 384, 397

[56] References Cited

U.S. PATENT DOCUMENTS

| | | | |
|---|---|---|---|
| 1,124,645 | 1/1915 | Overton | 440/54 |
| 2,156,938 | 5/1939 | Edwards | 440/54 |
| 3,158,346 | 11/1964 | Jagger | 440/900 |
| 3,191,452 | 6/1965 | Lipski et al. | 74/397 |
| 3,426,610 | 2/1969 | Scharer | 74/397 |

FOREIGN PATENT DOCUMENTS

| | | | |
|---|---|---|---|
| 750954 | 8/1933 | France | 440/54 |

*Primary Examiner*—Joseph F. Peters, Jr.
*Assistant Examiner*—Edwin L. Swinehart
*Attorney, Agent, or Firm*—Andrus, Sceales, Starke & Sawall

[57] ABSTRACT

A marine propulsion mechanism is provided with a variable height mechanism for varying the height of the propeller relative to a boat. The variable height mechanism includes an input gear connected to the engine drive shaft and an output gear connected to an output shaft which is adapted to drive the propeller. An idler gear is disposed between the input and output gears, and is movable about the input gear. A link is provided between the idler gear and the output gear for fixing the center-to-center relation of the idler and output gears, so that rotation of the idler gear about the input gear is translated into upward and downward movement of a movable housing portion to which the output gear is connected, and thereby the height of the propeller.

8 Claims, 2 Drawing Sheets

FIG. 1
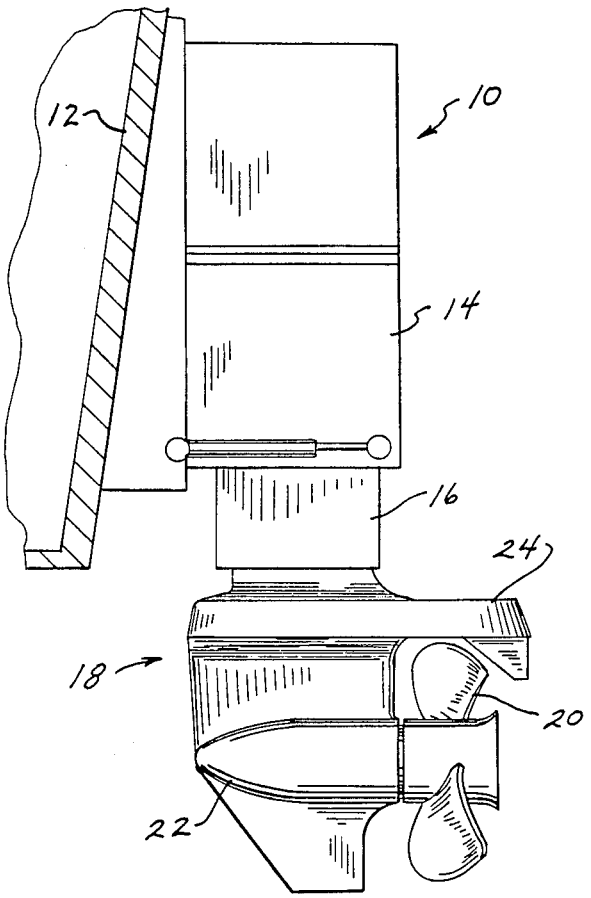
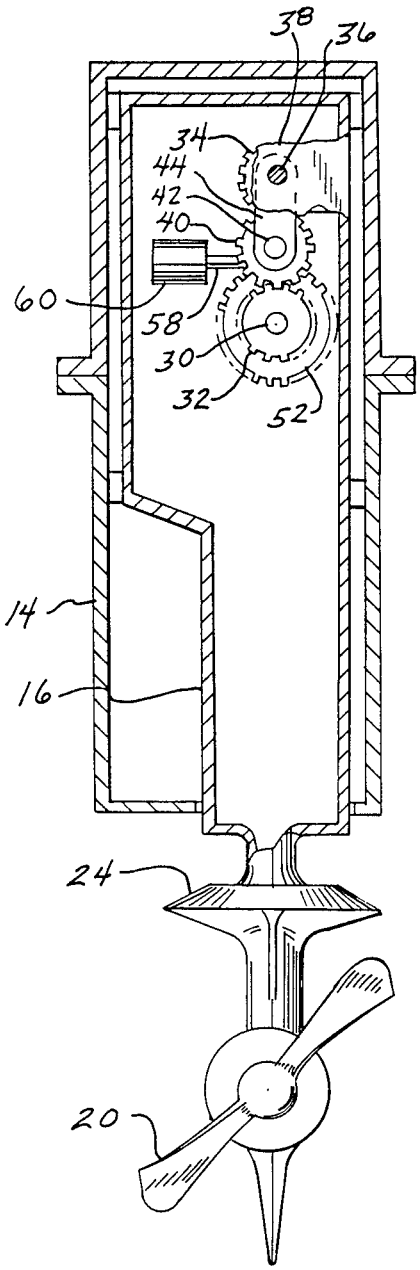
FIG. 2
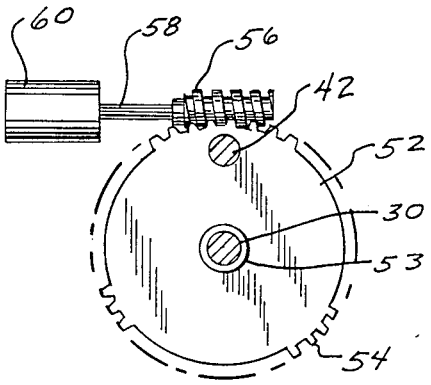
FIG. 4

FIG. 3
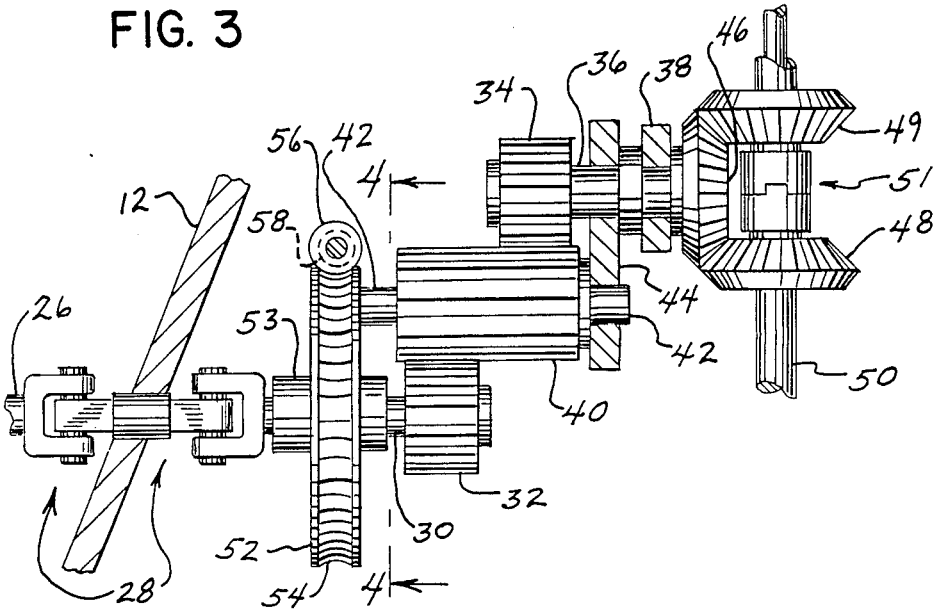
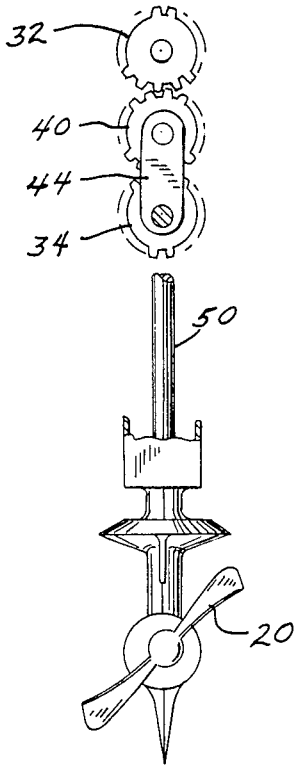
FIG. 5
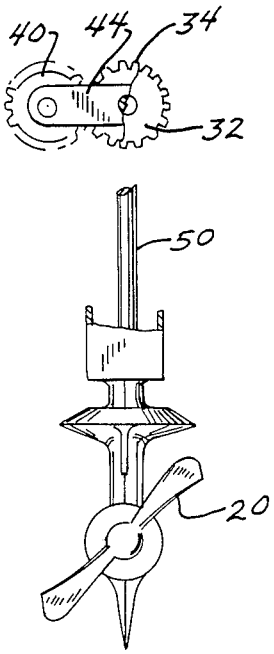
FIG. 6
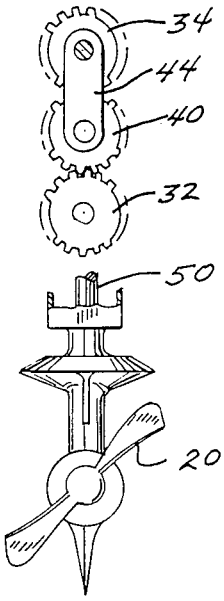
FIG. 7

VARIABLE HEIGHT MARINE PROPULSION MECHANISM

BACKGROUND AND SUMMARY

This invention relates to a marine propulsion system, and more particularly to a stern drive marine propulsion system having a mechanism for varying the height of the propeller relative to the boat.

In marine drives of conventional design, the propeller is maintained at a fixed elevation below the bottom of the boat. With such a fixed height of the propeller, engine and propeller design must strike a compromise between desirable top speed at full throttle and desirable acceleration characteristics. A fixed height propeller can also cause difficulties in low speed shallow water operation by forcing the aft end of the boat downward toward the bottom of the body of water, thus increasing the likelihood of the propeller encountering an obstruction.

The present invention is designed to minimize or eliminate the design compromise which must be reached between desirable top speed and acceleration characteristics caused by a fixed height propeller. The invention also overcomes problems encountered when running in shallow water. In accordance with the invention, a marine propulsion mechanism includes a drive shaft rotatably driven by an engine and a transmission adapted to be driven by the drive shaft. The propeller is interconnected with the transmission and is rotatably driven thereby, and variable height means is interconnected with the transmission for varying the height of the propeller relative to the boat. The variable height means allows the drive shaft to maintain a fixed position relative to the boat, and preferably is disposed between the drive shaft and the transmission. In one embodiment, the variable height means includes a stationary housing fixed to the boat and a movable housing to which the propeller is connected. The movable housing moves upward and downward relative to the stationary housing and the height of the propeller relative to the boat is determined by the position of the movable housing. The variable height means preferably provides operation of the transmission along the entire range of movement of the movable housing relative to the stationary housing. A drive means is provided for moving the movable housing relative to the stationary housing. In one embodiment, a rotary input member is connected to the drive shaft and a rotary output member is connected to the transmission shaft. A rotary idler member is disposed between and engageable with the rotary input and output members. The rotary output member is interconnected with a fixed member provided on the movable housing. The drive means includes a rotatable wheel to which a shaft extending through the idler member is fixed. Rotation of the rotatable wheel causes the idler member to rotate about the rotary input member. A link or the like is connected between the rotary idler member and the rotary output member to maintain the center-to-center relation between such members. In this manner, rotation of the rotary wheel and movement of the idler member about the input member causes upward or downward movement of the rotary output member, and thereby upward or downward movement of the movable housing.

BRIEF DESCRIPTION OF THE DRAWINGS

The drawings illustrate the best mode presently contemplated of carrying out the invention.

In the drawings:

FIG. 1 is a partial elevation view showing a stern drive marine propulsion mechanism incorporating the variable height mechanism of the invention;

FIG. 2 is a rear elevation view partially in section, internal components of the variable height mechanism;

FIG. 3 is a detailed side elevation view, partially in section, showing the variable height mechanism of the invention;

FIG. 4 is a sectional view taken generally along line 4—4 of FIG. 3;

FIG. 5 is a schematic showing of the marine drive mechanism as positioned in its lowermost position by the components of the variable height mechansim;

FIG. 6 is a view similar to FIG. 5, showing the marine drive mechanism in an intermediate position; and FIG. 7 is a view similar to FIGS. 5 and 6, showing the marine drive mechanism in its uppermost position.

DETAILED DESCRIPTION OF THE PREFERRED EMBODIMENT

With reference to FIG. 1, a stern drive unit 10 is connected to the transom 12 of a boat. Stern drive 10 is provided with a variable height mechanism, which includes a constant elevation housing 14 and a movable housing 16. Constant elevation housing 14 is mounted to transom 12 for steering about a vertical axis and for tilting about a horizontal axis. A conventional stern drive lower unit 18 is connected to the lower end of movable housing 16. Lower unit 18 includes a propeller 20 connected to a propeller shaft (not shown) housed within a torpedo 22, and an anti-cavitation plate 24.

With reference to FIGS. 2 and 3, a drive shaft 26, adapted to be driven by an inboard engine, as is well known, is connected at its rightward end to a double U-joint assembly 28 for providing steering and tilt functions to stern drive 10. An input shaft 30 is connected to the rightward end of universal joint assembly 28 and extends rearwardly therefrom. Input shaft 30 has an input gear 32 mounted thereto, which is rotatable in response to rotation of drive shaft 26.

An output gear 34 is connected via an output shaft 36 to a bracket 38. Bracket 38 extends interiorly of movable housing 16, and is rigidly connected to a side wall thereof.

An idler gear 40 is disposed between and is engageable by input gear 32 and output gear 34. Idler gear 40 is rotatable about an idler shaft 42. Idler shaft 42 projects from the rightward end of idler gear 40, and such projecting portion of idler shaft 42 is engageable with an opening provided at one end of a link 44. Link 44 is provided at its other end with an opening through which output shaft 36 extends, so as to fix the center-to-center relation of output gear 34 and idler gear 40.

As explained, rotation of drive shaft 26 causes rotation of input gear 32, which is transmitted through idler gear 40 to output gear 34. Rotation of output gear 34 imparts rotation to output shaft 36, which is connected at its rightward end to an output bevel gear 46 which is engageable with a forward gear 48 and a reverse gear 49 provided on the upper end of a vertical transmission shaft 50. A reversing transmission 51 is provided between forward and reverse gears 48, 49 for controlling the direction of rotation of transmission shaft 50, and thereby the direction of rotation of propeller 20. As is well known, transmission shaft 50 is engageable at its lower end with a bevel gear which drives the propeller shaft to which propeller 20 is connected. It should be understood that the transmission mechanism, shown at 51, may be incorporated at any satisfactory location. For example, the transmission may be located in torpedo 22, as in a conventional outboard system, or between the engine and input shaft 26.

The leftward end of idler shaft 42 is rigidly connected to a drive wheel 52, which is mounted to input shaft 30 with suitable bearings or the like, shown at 53. Drive wheel 52 is provided with a series of teeth 54 about its outer circumference. Teeth 54 are engageable by a worm gear 56 which is rotatable in response to rotation of a shaft 58 connected to a motor 60 (FIG. 4).

In operation, the variable height mechanism of the invention works as follows. Rotation of shaft 58 by motor 60 causes rotation of worm gear 56, and thereby clockwise or counterclockwise rotation of drive wheel 52 about input shaft 30. Due to the connection of idler shaft 42 to drive wheel 52, such rotation of drive wheel 52 causes idler gear 40 to rotate either clockwise or counterclockwise about input gear 32. Because the center-to-center relation of output gear 34 to idler gear 40 is fixed by link 44, rotation of idler gear 40 about input gear 32 causes upward or downward movement of output gear 34 accordingly. Bracket 38 can only move upwardly and downwardly in a straight line, and upward or downward movement of output gear 34 is transferred to bracket 38 through link 44 and output shaft 36. The upward or downward movement of output gear 34 is translated through bracket 38 to movable housing 16, which accordingly telescopes inwardly or outwardly with respect to constant elevation housing 14 to thereby control the height of propeller 20 with respect to the boat.

As shown in FIG. 5, idler gear 40 is at a six o'clock position with respect to input gear 32. In this position, output gear 34 is at its lowermost position, as is propeller 20. In FIG. 6, idler gear 40 is at a nine o'clock position with respect to input gear 32. In this position, output gear 34 is coaxial with input gear 32, and propeller 20 is at an intermediate elevation. In FIG. 7, idler gear 40 is at a twelve o'clock position with respect to input gear 32, and output gear 34 is accordingly at its uppermost position.

Various alternatives and modifications are contemplated as being within the scope of the following claims particularly pointing out and distinctly claiming the invention.

I claim:

1. In a marine propulsion system for a boat, said system including an engine, a drive shaft rotatably driven by said engine, a rotary input member connected to said drive shaft, a propeller, and power transfer means disposed between said drive shaft and said propeller and including an output shaft for transferring rotary power to said propeller, the improvement comprising variable height means for varying the height of the propeller relative to the boat, said variable height means comprising:

a first housing portion fixed at a constant elevation relative to said boat;

a movable housing portion movable relative to said first housing portion for controlling the elevation of said propeller;

drive means for moving said housing portion relative to said first housing portion;

a fixed member mounted to the interior of said movable housing portion;

a rotary output member connected to said output shaft and interconnected with said fixed member;

a rotary idler member disposed between and engageable by said rotary input and output members so as to transmit rotary power from said rotary input member to said rotary output member; and means for fixing the center-to-center relation of said rotary idler member and said rotary input member;

wherein said drive means causes said rotary idler member to rotate about said rotary input member so as to alter the height of said rotary output member relative to said rotary input member and thereby the position of said movable housing portion relative to said first housing portion; and wherein said variable height means allows said drive shaft to maintain a constant position relative to said boat and provides operation of said marine propulsion system along the entire range of movement of said movable housing portion relative to said first housing portion.

2. The invention according to claim 1, wherein said fixed member mounted to the interior of said movable housing portion comprises an inwardly extending bracket mounted to a wall of said movable housing and adapted to receive a shaft to which said rotary output member is mounted.

3. The invention according to claim 1, wherein said means for fixing the center-to-center relation of said rotary idler member and said rotary output member comprises a rigid link pivotable at one end about the center line of said rotary output member and at the other end of about the center line of said rotary idler member.

4. The invention according to claim 3, wherein said link is connected at said one end to a shaft about which said rotary idler member rotates, and at the other end to a shaft connected to said rotary output member.

5. The invention according to claim 1, wherein said drive means comprises a shaft about which said rotary idler member is rotatable and having a portion extending from said rotary idler member shaft, said extending portion of said shaft being connected at an end thereof to a rotatable member having a center coaxial with the center of said rotatable input member, said connection of said extending portion of said shaft to said rotatable member being offset with respect to the center of said rotatable member, and further comprising means for imparting rotation to said rotatable member about its center, whereby rotation of said rotatable member causes said idler member to rotate about said input member so as to alter the height of said rotary output member relative to said rotary input member.

6. The invention according to claim 5, wherein said rotatable member includes a series of teeth about its outer circumference, and wherein said means for imparting rotation to said rotatable member is engageable with said series of teeth so as to provide rotation of said rotatable member.

7. The invention according to claim 6, wherein said means for imparting rotation to said rotatable member comprises a rotatable worm engageable with said series of teeth provided on the outer circumference of said rotatable member, said worm having a shaft extending therefrom capable of being selectively rotatable so as to control the height of said movable housing portion relative to said first housing portion in response to rotation of said worm shaft.

8. For a marine propulsion system for use in a boat, said system including an engine and a substantially horizontal input shaft rotatably driven by said engine, a propeller connected to a propeller shaft, and a substantially horizontal output shaft for driving said propeller shaft, a variable height mechanism for varying the height of said propellor relative to said boat, said variable height mechanism comprising:

a first gear driven by said input shaft;

a second gear driving said output shaft;

means imprinting rotation to said second gear in response to rotation of said first gear;

means fixing the vertical position of said first gear relative to said input shaft;

means fixing the vertical position of said second gear relative to said output shaft; and means for adjusting the vertical position of said first gear relative to said second gear, whereby such adjustment in the vertical position of said first gear relative to said second gear results in upward or downward movement of said output shaft, and thereby of said propeller, relative to said boat, said variable height mechanism providing continuous rotation of said output shaft in response to rotation of said input shaft during said upward or downward movement of said output shaft.

* * * * *